US005594304A

United States Patent [19]

Graber

[11] Patent Number: 5,594,304

[45] Date of Patent: Jan. 14, 1997

[54] PORTABLE FLUORESCENT LAMP FOR USE IN SPECIAL APPLICATIONS

[75] Inventor: Warren S. Graber, Iverness, Ill.

[73] Assignee: Woodhead Industries, Inc., Buffalo Grove, Ill.

[21] Appl. No.: 508,378

[22] Filed: Jul. 31, 1995

[51] Int. Cl.[6] ..... H01J 1/52; H01J 65/04

[52] U.S. Cl. ..... 315/85; 315/39; 315/58; 315/248; 315/344

[58] Field of Search ..... 315/248, 338, 315/344, 58, 59, 85, 39, 39.53; 313/160, 161, 167, 231.61, 248, 493; 362/362, 363, 376, 377, 378, 391

[56] References Cited

U.S. PATENT DOCUMENTS

| | | | |
|---|---|---|---|
| 4,117,378 | 9/1978 | Glascock, Jr. | 315/248 |
| 4,227,120 | 10/1980 | Luborsky | 315/248 |
| 4,644,456 | 2/1987 | Lyde II | 362/376 |
| 4,922,157 | 5/1990 | Van Enger et al. | 315/248 |
| 5,027,041 | 6/1991 | Godyak | 315/248 |
| 5,170,332 | 12/1992 | Browne | 362/376 |
| 5,175,476 | 12/1992 | Anderson et al. | 315/248 |
| 5,220,236 | 6/1993 | Washburn | 313/26 |
| 5,289,085 | 2/1994 | Godyak | 315/248 |
| 5,300,860 | 4/1994 | Godyak | 315/39 |
| 5,325,018 | 6/1994 | El-Hamamsy | 315/85 |
| 5,325,024 | 6/1994 | Piejak | 315/248 |
| 5,343,126 | 8/1994 | Farrall | 315/248 |
| 5,397,966 | 3/1995 | Vrionis et al. | 315/248 |
| 5,465,028 | 11/1995 | Antonis et al. | 315/248 |
| 5,519,587 | 5/1996 | Baggio et al. | 362/21 |

*Primary Examiner*—Benny Lee
*Assistant Examiner*—Haissa Philogene
*Attorney, Agent, or Firm*—Emrich & Dithmar

[57] ABSTRACT

A fluorescent lamp for use in special applications includes an electrodeless envelope of glass or other light transmissive material carrying fluorescent material within the envelope. An RF energy source and coupler are embedded in epoxy as an integral power unit, thereby isolating the power unit from the hazardous environment. The power unit and the envelope are shaped in complementary form such that the coupler and envelope are in energy-transfer relation to excite the lamp, but the envelope may be removed from the power unit to re-lamp the fixture.

10 Claims, 1 Drawing Sheet

PORTABLE FLUORESCENT LAMP FOR USE IN SPECIAL APPLICATIONS

FIELD OF THE INVENTION

The present invention relates to fluorescent lamps; and more particularly, it relates to a portable fluorescent lamp for use in special applications. As used herein, "special applications" is intended as a broad term which refers to use environments other than the normal domestic, commercial or industrial use.

BACKGROUND OF THE INVENTION

Special applications include use in damp, or even wet applications, as are found in food plants, for example, where a salt spray might be used and produce a constant mist, or in chemical plants, or in manufacturing environments where volatile or inflammable solvents are used in the manufacturing process. In the damp or wet environments, the problem of corrosion exists with attendant reduction in the life of the fixture. In hazardous environments, safety requirements dictate that the possibility of an electrical discharge or spark be accounted for and either eliminated or encapsulated so that it is isolated from the environment in which the fixture is used. Alternatively, operating circuits may be designed to operate at inherently safe power levels, as discussed further below.

For brevity, reference will be made more frequently herein to hazardous environment application than wet, damp or other special applications. Persons skilled in the art will readily appreciate the facility with which the present invention is accommodated to many-different applications. One application where the present invention might have particular utility, as an example, might be a manufacturing plant for aircraft or a petroleum refinery where the use of volatile solvents and other flammable liquids or fumes are present. In most of these applications, it is desirable that the lighting be portable. From the user's standpoint, it is also desirable that the fixture be capable of being re-lamped without the use of special tools or devices because unless substitute lighting is available, when a lamp burns out, production may have to be curtailed or shut down, and safety may be compromised if supplemental light is not available.

Lighting has been designed for hazardous duty applications using incandescent lamps. However, incandescent lamps, particularly those capable of generating larger outputs of light, operate at fairly high temperatures, and therefore may create another potential hazard, particularly in an environment of volatile materials. Fluorescent lamps have also been incorporated in lighting for hazardous applications. However, fluorescent lamps typically require one hundred volts or more to initiate discharge, as well as for continual operation. Thus, precautions have to be made to reduce the possibility of arcing.

Conventional fluorescent lamps have electrodes passing through the glass envelope for connecting to the power source. In order to be able to replace the lamp, the electrodes are mounted in sockets in such a manner that they normally are exposed to the environment, again, unless special precautions are taken.

In some designs employing conventional fluorescent lamps, where leads, terminals, circuit elements or electrodes are exposed to the environment, designers have designed circuitry to operate at "intrinsically safe" power levels. This term is known in the art and refers to predetermined operating levels of voltage and current for switching circuits to insure that arcing will not occur. Although circuit designs can incorporate requirements for inherently safe circuit operation, that is not the case for fluorescent lamps and it becomes next to impossible to achieve an inherently safe control or ballast circuit for a conventional fluorescent lamp wherein the entire control and power system operates at inherently safe levels and still permit the fixture to be conveniently re-lamped. Thus, whereas operating or control circuits may operated at inherently safe levels, the power portions of circuitry for conventional fluorescent lighting cannot, and some other provisions (such as air purging) must be made for operation of conventional fluorescent lamps in hazardous environments.

One attempt to overcome the problems associated with operating conventional fluorescent lamps in a hazardous environment is described in the co-pending application of Baggio and Granat entitled AIR PURGED PORTABLE ELECTRIC LAMP, Ser. No. 431,308, filed Apr. 28, 1995. In that application, the fluorescent lamps and the power source are housed in an enclosure which is purged with breathable air before power is applied to the fluorescent lamp. Although these devices have been useful and represent an advance in the art, they require a separate source of breathable air, conduit or tubing routing the air from the source to the location of use, and circuitry for controlling the purging cycle and sensing when the breathable air is not flowing through the enclosure to purge the interior of the enclosure. Moreover, because the lamps are housed in a sealed environment except for the entrance and discharge of the breathable air, it normally requires that the fixtures be taken out of use and lamps replaced at a remote location where tools and the like are required.

Electrodeless lamp technology has been developed in which electrodes do not pass through the glass envelope of a fluorescent lamp. However, electrodeless lamp technology to date has been directed primarily to domestic or commercial applications in which the RF source, coupling mechanism and lamp are all integrated into a screw-type base so that it might replace the conventional incandescent lamp, such as is shown, for example, in U.S. Pat. Nos. 4,171,378 and 5,220,236. Other examples of the application of electrodeless lamp technology have characteristics similar to these two applications which prevent their use in hazardous or wet locations, for example, because the attempt has been to integrate the power source integrally with the lamp, leaving some portion of the input power supply lines, power supply or coupler in contact with, or not sealed from the environment in which the fixture is intended to operate.

SUMMARY OF THE INVENTION

The present invention is directed to a modification of the electrodeless lamp technology which enables it to be useful in special applications such as the ones mentioned above. According to the present invention, a fluorescent lamp includes an electrodeless envelope of glass or other light-transmissive material carrying fluorescent material within the envelope. An RF energy source and coupler are embedded in epoxy as an integral power unit, isolated from the environment. The power supply line coupling a conventional energy source to the RF energy source has the connection to the RF energy source also embedded in epoxy.

The power unit and the envelope are shaped in complementary form such that the coupler and envelope are in energy-transfer relation to excite the lamp during use, but they are separated by the sealant. Thus, the envelope, though it may be mechanically mounted to the epoxy-covered power unit, may also be removed from the power unit to re-lamp the fixture.

One advantage of the present invention, then, is that all of the fixture which has any electrical voltage or current is completely embedded in epoxy. Epoxy is recognized as a substance which creates a seal or encapsulation which permits electrical circuitry to operate safely (i.e. without fear of spark) even in hazardous environments. Not only is the possibility of a spark eliminated, but corrosion normally associated with salt environments and other environments having corrosive chemicals or volatile materials, is eliminated.

Another advantage of the present invention is that re-lamping can be made simple and direct without the use of special locations, and the fixture can be re-lamped right in the hazardous environment so that any interruption in the manufacturing process is kept to a minimum.

Another advantage of the present invention is that it is much more flexible and adaptable to different use applications since it does not have the bulk of conventional fluorescent tubes with their awkward length.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF THE PREFERRED EMBODIMENT

Figure 1:
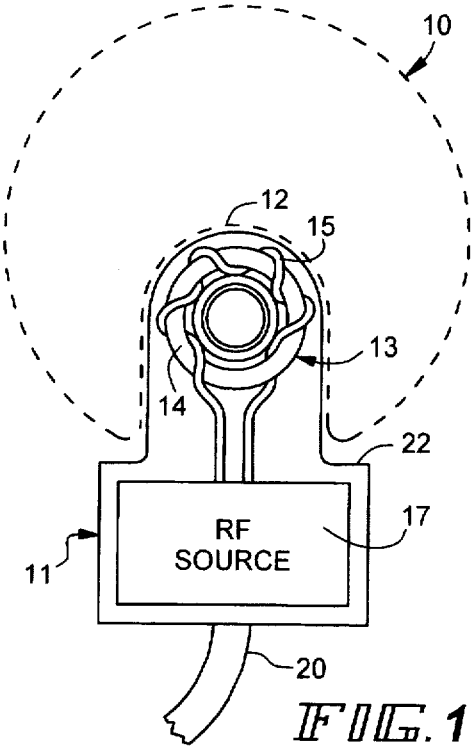
FIG. 1 is a diagrammatic view of a first electrodeless lamp including a electromagnetic coupler according to the present invention.

Referring first to FIG. 1, reference numeral 10 generally designates a diagrammatic outline of a light-transmissive envelope of a globular fluorescent lamp of the type commonly referred to as electrodeless. The envelope 10, which preferably may be of glass or other light-transmissive material, is filled with an ionizable gas (for example, a mixture of a rare gas such as krypton and/or argon and mercury vapor and/or cadmium vapor). The interior surface of the envelope 10 are coated in a well-known fashion with a suitable phosphor which, when stimulated or excited by an electromagnetic field, emits visible radiation upon absorption of ultraviolet radiation, in a manner similar to that in which conventional fluorescent lamps operate.

In the illustrated embodiment, the envelope 10 has a portion formed into a cavity 12 for receiving a portion of an RF power unit generally designated 11. Power unit 11 includes an RF power source and a coupler. In the embodiment of FIG. 1, an electromagnetic coupling element is generally designated 13. The electromagnetic coupler 13 includes a core 14 in the form of a ring, and which may be formed in a toroidal shape having a generally round and uniform cross section. A winding 15 is wound around the core 14 and energized by a conventional source of RF current generally designated 17. The structure thus far described is disclosed in U.S. Pat. No. 4,117,378, which disclosure is incorporated herein by reference. In that patent, however, the glass envelope and RF power source are integrally mounted into a base which is provided with a conventional screw-type mounting for conventional sockets.

In the illustrated embodiment, on the other hand, a flexible power cord 20, which may be coupled to a conventional plug adapted to be received in a wall socket, for example (not shown for brevity) couples power to the RF source 17. The RF source and terminal end of the power cord 20 (i.e., the entire power unit), as well as the leads from the RF power source 17 to the winding 15 and the electromagnetic coupler itself, are all encased in epoxy. The envelope of the epoxy covering is diagrammatically illustrated by the solid line 22; and it encompasses, covers and seals all of the elements carrying an electrical voltage or circuit which could in any way be directly exposed to the environment in which the fixture shown in FIG. 1 may be used. Moreover, that portion of the epoxy covering 22 which covers the coupler 13 is molded to be received in and engage the surface of the cavity 12 of the envelope 10 so that the electromagnetic coupler 13 is properly positioned inside the lamp envelope 10 for use in accordance with the teachings of the prior art. That is, the coupler 13 generates a radio frequency magnetic field within the core 14 when excited by the RF power source 17. The resulting magnetic field induces a solenoidal electric field in the ionizable gas contained within the envelope 10. The RF magnetic field ionizes the gas within the envelope and stimulates the emission of ultraviolet radiation from the gas, and the ultraviolet radiation impinges on the phosphor deposited within the lamp 10 for generating visible light.

In the embodiment illustrated in FIG. 1, the envelope 10 seats firmly and snugly on the portion of the power unit 11 which encompasses the magnetic coupler, so that if the lamp 10 becomes non-functional, it may be replaced. However, additional structure can be provided so that the envelope 10 and the coupler 13 may be more securely, but removably coupled together. The provision of the epoxy covering 22 and the flexible power cord 20 to the RF power source 17 permit the fixture shown in FIG. 1 to be portable, and yet to be adaptable for either a hazardous location, a damp location, or even a wet location. In fact, it may be submersed in water without deleterious effect on the RF power source or the magnetic coupler 13, though the unit shown is not intended for continuous underwater use.

Figure 2:
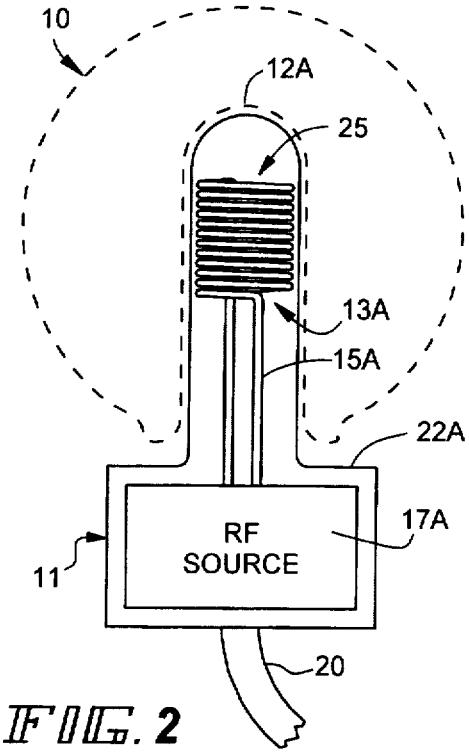
FIG. 2 is a diagrammatic view of a second embodiment of an electrodeless lamp incorporating a magnetic coupler constructed according to the present invention.

Turning now to the embodiment of FIG. 2, the glass envelope is again designated by reference numeral 10 and the power unit 11. The envelope is provided with a cavity 12A for receiving electromagnetic coupler 13A comprising coil formed from a winding 15A which surrounds a torroid (not shown) and excited by an RF power source **17*a***.

In the embodiment of FIG. 2, the winding 15A forms a coil 25 having spiral turns and defines a generally vertical axis parallel to the axis of the elongated socket **12*a*. Again, RF current flows through the winding 15A and establishes a radio frequency magnetic field about the coil 25 (in the form of a toroid having a mid-plane lying horizontally and perpendicular to the plane of the page of FIG. 2). The RF electromagnetic field induces an electric field within the envelope 10**. The field ionizes and excites the gas within the envelope resulting in a discharge which generates ultraviolet radiation which is absorbed by and excites the phosphor coating on the interior surface of the envelope, thereby stimulating the emission of a visible radiation by the lamp envelope.

As in the embodiment of FIG. 1, the flexible power cord 20 coupling conventional alternating voltage to the RF power source 17A, the RF power source 17A itself, the lead 15A and the winding 25 are all encapsulated by and embedded within epoxy material 22A.

Figure 3:
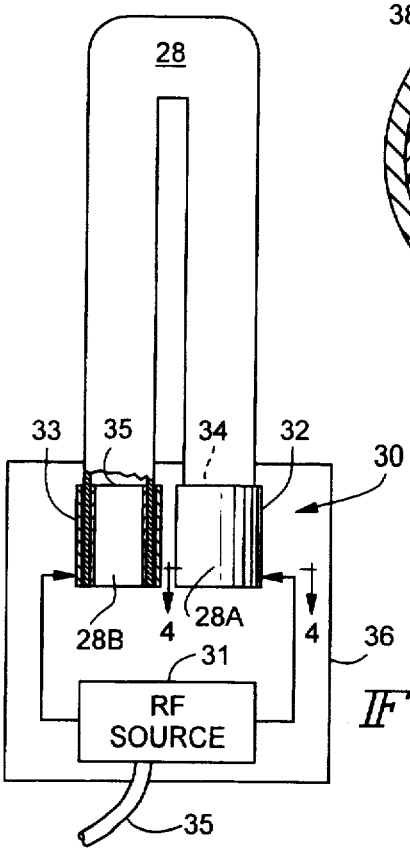
FIG. 3 is a diagrammatic view of a third embodiment of an electrodeless lamp incorporating a capacitive coupler constructed according to the present invention.

Turning now to the embodiment of FIG. 3, a fluorescent lamp is generally designated 28, and it is in the form of a cylindrical tube which is bent at its mid-section to form an inverted U. This configuration is conventional and is sometimes referred to as a "twin tube" or a biaxial lamp. The inclusion of phosphors deposited on the interior of the glass envelope and the ionizable gases is the same as other fluorescent lamps. However, there is no starter or filament. Rather, the coupler in this case, which is generally designated as numeral 30 is a capacitive coupler.

The capacitive coupler 30 includes an RF power source 31, and first and second ring electrodes 32, 33 which surround respectively the adjacent free ends 28A, 28B of the biaxial tube 28. On the interior of the adjacent free ends, at or near the distal ends thereof, there are deposited on the interior surface of the glass tube, interior ring electrodes 34, 35 respectively. Thus, the exterior ring electrode 32 and the associated interior ring electrode 34 form one capacitative coupling to one end of the biaxial tube 28, and the exterior ring electrode 33 and its associated interior ring electrode 35 form a second capacitive coupling. Both of the exterior ring electrodes 32, 33 are energized by the RF power source 31. A field is created inside the tube 28, between interior electrodes 34, 35 which ionizes the gas inside the tube. Other configurations of capacitive-coupled electrodeless lamps as well as combinations employing both capacitative and inductive couplers are described in U.S. Pat. No. 5,300,860, the disclosure of which is incorporated herein by reference.

The exterior ring electrodes 32, 33 as well as the RF power source 31 and its associated power leads 35, which may be flexible, as described above, are embedded in an epoxy material, the envelope of which is diagrammatically illustrated at 36 similar to the one described above.

Figure 4:
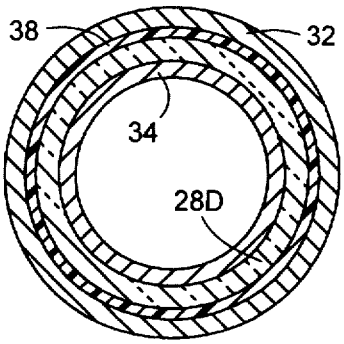
FIG. 4 is a cross section taken through the sight line B—B of FIG. 3.

Turning now to FIG. 4, there is shown a cross section of one of the free ends of the tube 28. The glass envelope is designated 28D for one of the tube sections for the biaxial tube 28; the interior ring electrode is designated 34, and the exterior ring electrode is shown at 32 in FIG. 4, the epoxy covering again being shown at 38. It will be observed that the epoxy is formed into two cup-shaped receptacles or sockets for the free ends 28A, 28B of the biaxial fluorescent tube 28 so that it may be assembled to the combination of power lead, RF power source and exciting capacitor coupling, but be removed in the event that re-lamping is necessary.

Figure 5:
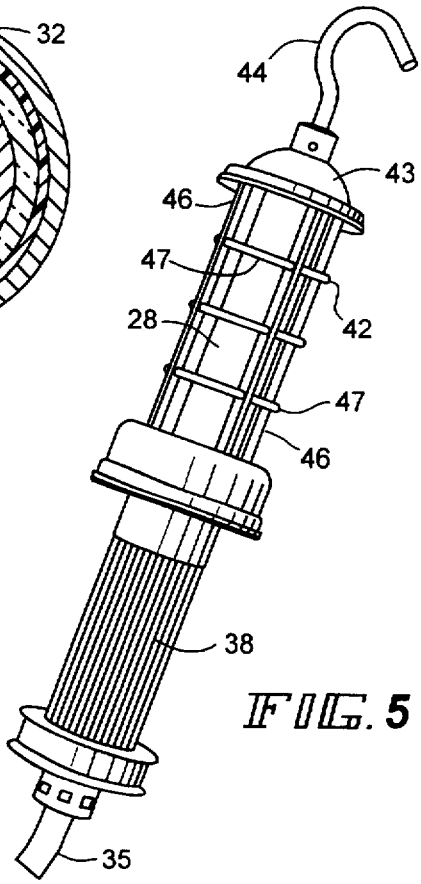
FIG. 5 is a side view of a portable hand lamp constructed according to the present invention and incorporating an electromagnetic radiation shield.

Turning now to FIG. 5, there is shown a structure for housing a portable handlamp employing the construction of the present invention shown in FIG. 3. The flexible power cord is again designated 35, and it is coupled into a metal base 38 which is sized to be conveniently held in one hand. Housed within the base 38 would be the epoxy-encompassed RF power source 31 and the exterior ring electrodes 32, 33. The biaxial tube 28 is received in the sockets formed by the epoxy compound, and an exterior protective screen or gridwork, of metal, surrounds the tube 28, and is designated 42. The upper portion of the protective grid 42 is covered with a coventional metal cap 43 which may be provided with a convenience hanger 44. The grid 42 is formed from interconnected axial elements 46 and circumferential elements 47 to form an EMI suppression grid. The spacing of the elements of the grid 42 is related to the wavelength of the operating frequency (or harmonics) of RF source to suppress electromagnetic interference as desired according to principles well known to those skilled in the art. In this case, the metal grid forms not only a protective function for the lamp 28, but it also provides an electromagnetic interference shield.

In addition to those embodiments which have been illustrated, there are other configurations of glass envelopes as well as other excitation devices or couplers to which the invention is readily adaptable. For example, it is known that the glass envelope 10 for an electrodeless lamp may be in the form of a toroid, and the coupler may be in the form of a coil surrounding a portion of the toroid in a circumferential manner.

In order to re-lamp this type of fixture, the coupler is made into a split coil so that it may be removed from the lamp. In this case, the coupler may be designed so that each portion of the winding is fixed on a ferrite material of semi-toroidal shape, and conforming to the shape of the glass envelope when the two halves of the coupler are assembled. The RF power source for exciting the coupler may be conventional. This type of structure is sometimes referred to as a "tokomac" design, and a person skilled in the art will readily appreciate that the present invention may be modified and accommodated to it.

Still another modification is to extend the application to high-intensity discharge (HID) lamps. Electrodeless HID lamps are now commercially available.

Having thus disclosed in detail preferred embodiments of the invention, persons skilled in the art will be able to modify certain of the structures which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. An electrodeless lamp for use in special applications such as hazardous or wet environments, comprising:

a light-transmissive envelope enclosing a gaseous medium adapted to sustain an electric discharge and luminous phosphors disposed on interior surfaces of said envelope and adapted to emit visible light when excited by ultraviolet radiation emitted from said gaseous medium:

a source of RF energy adapted to receive electrical power for generating an RF electrical signal;

an energy coupler electrically coupled to the output of said RF source and for being excited by said RF signal, said coupler being shaped to conform to the shape of a portion of said envelope and to cooperate therewith such that said coupler may be assembled to said envelope in energy-transfer relation; and potting material encasing said RF source and said coupler and conforming to the shape of said coupler as it is accommodated by said envelope;

said lamp being characterized in that said envelope is removably assembled to said coupler in said energy-transfer relationship and may readily be removed and replaced.

2. The apparatus of claim 1 wherein said envelope is generally spherical and closed and defines an inwardly extending cavity having an exterior surface of predetermined shape to receive said coupler; and said coupler is an electromagnetic coupler received in said cavity and entirely enclosed within said potting material and separated from said exterior surface of said cavity by said potting material.

3. The apparatus of claim 1 wherein said lamp is a fluorescent lamp generally U-shaped with said envelope defining first and second legs in a biaxial formation with distal ends adjacent each other; and wherein said coupler is capacitive having a first electrode inside of each leg and adjacent the distal end thereof, and a second electrode exterior of each leg said first and second electrodes for each by being in energy-coupling relation; and further characterized in that said second electrodes are enclosed within said potting material and said potting material and said second electrodes conform to the shape of said envelope adjacent said first electrodes.

4. The apparatus of claim 1 further including a metal grid surrounding of said envelope and designed and arranged to reduce electromagnetic interference emitted from said lamp.

5. The apparatus of claim 4 wherein said grid further provides mechanical strength to protect said envelope against breakage and to reduce the hazard of breakage.

6. An electrodeless fluorescent lamp for use in special applications such as hazardous or wet environments, comprising:

a light-transmissive envelope enclosing a gaseous medium adapted to sustain an electric discharge and luminous phosphors disposed on interior surfaces of said envelope and adapted to emit visible light when excited by ultraviolet radiation emitted from said gaseous medium, said envelope being shaped to define a cavity for receiving an energy coupler;

a source of RF energy adapted to receive electrical power for generating an RF electrical signal;

an electromagnetic coupler integrally secured with said RF signal, said coupler being shaped to conform to at least a portion of said envelope and to cooperate therewith such that said coupler may be assembled to said envelope in energy-transfer relation; and potting material encasing said RF source and said coupler and conforming to the shape of said coupler as it is accommodated by said envelope; and characterized in that said envelope is removably assembled to said coupler in said energy-transfer relationship and may readily be replaced.

7. The apparatus of claim 6 wherein said envelope is generally spherical and closed and defines an inwardly extending cavity having an exterior surface of predetermined shape to receive said coupler; and said coupler is entirely enclosed within said potting material and separated from said exterior surface of said cavity by said potting material.

8. An electrodeless fluorescent lamp for use in special applications such as hazardous or wet environments, comprising:

a light-transmissive envelope in the form of a biaxial tube having adjacent ends, said envelope enclosing a gaseous medium adapted to sustain an electric discharge and having luminous phosphors disposed on interior surfaces of said envelope and adapted to emit visible light when excited by ultraviolet radiation emitted from said gaseous medium;

a source of RF energy adapted to receive electrical power for generating an RF electrical signal;

a capacitive coupler integrally secured with said RF source and electrically connected to the output thereof for being excited by said RF signal, said coupler being shaped to conform to the adjacent ends of said tube and to cooperate therewith such that said coupler may be removeably assembled to said envelope in energy-transfer relation; and potting material encasing said RF source and said coupler and conforming to the shape of said coupler as it is accommodated by said envelope.

9. The apparatus of claim 8 wherein said envelope coupler has a first electrode inside of each leg and adjacent an associated end thereof, and a second electrode exterior of each leg each second electrode being in energy-transfer relation with an associated one of said first electrodes; and characterized in that said second electrodes are enclosed within said potting material and said potting material and said second electrodes conform to the shape of said envelope adjacent said first electrodes.

10. The apparatus of claim 9 further comprising a conductive grid enclosing said coupler and said lamp, said grid comprising conductive elements constructed and arranged to suppress electromagnetic interference from said RF source.

* * * * *

UNITED STATES PATENT AND TRADEMARK OFFICE

CERTIFICATE OF CORRECTION

PATENT NO. : 5,594,304

DATED : January 14, 1997

INVENTOR(S) : Warren S. Graber

It is certified that error appears in the above-identified patent and that said Letters Patent is hereby corrected as shown below:

Claim 3, Col. 7, line 14, after "leg" insert --,--; and line 15 "by" should be --leg--.

Claim 9, Col. 8, line 36, after "leg" insert --,--.

Signed and Sealed this

Fifteenth Day of July, 1997

Bruce Lehman

*Attest:*

BRUCE LEHMAN

*Attesting Officer*

*Commissioner of Patents and Trademarks*